US007420880B2

(12) United States Patent
Burkhardt et al.

(10) Patent No.: US 7,420,880 B2
(45) Date of Patent: Sep. 2, 2008

(54) MULTIMODE ELECTRONIC DEVICE WITH CALIBRATING/SETTING MECHANISM

(75) Inventors: Wolfgang Burkhardt, Ispringen (DE); Gerhard Stotz, Eisingen (DE); Hans Schnell, Karlsbad-Langensteinbach (DE); Martin Dietrich, Neuenburg (DE); Ulrich Kalmbach, Pforzheim (DE); Michel G. Plancon, Besancon (FR)

(73) Assignee: Timex Group B.V., NL ( * ) Notice: Subject to any disclaimer, the term of this patent is extended or adjusted under 35 U.S.C. 154(b) by 19 days.

(21) Appl. No.: 11/473,716

(22) Filed: Jun. 23, 2006

(65) Prior Publication Data

US 2007/0153635 A1 Jul. 5, 2007

Related U.S. Application Data

(60) Provisional application No. 60/754,851, filed on Dec. 29, 2005.

(51) Int. Cl.
*G04B 19/24* (2006.01)
*G04B 19/20* (2006.01)

(52) U.S. Cl. ..... 368/28; 368/35

(58) Field of Classification Search ..... 368/28, 368/35, 37, 39

See application file for complete search history.

(56) References Cited

U.S. PATENT DOCUMENTS 4,451,159 A * 5/1984 Tanaka ..... 368/69
4,766,579 A * 8/1988 Sporring ..... 368/190
5,202,858 A * 4/1993 Kanzaki ..... 368/71
5,377,168 A * 12/1994 Kotanagi ..... 368/69
5,440,527 A 8/1995 Okamoto
6,490,230 B1 12/2002 Sakuyama et al.
6,735,151 B2 * 5/2004 Triponez ..... 368/28
7,027,360 B2 * 4/2006 Kitahara et al. ..... 368/28
2002/0024887 A1 2/2002 Triponez

FOREIGN PATENT DOCUMENTS

EP 0 488 249 A2 6/1992
EP 1 341 063 A2 9/2003

* cited by examiner

*Primary Examiner*—Edwin A. Leon
*Assistant Examiner*—Thanh S Phan
(74) *Attorney, Agent, or Firm*—Carmody & Torrance LLP

(57) ABSTRACT

An electronic device comprising a controller having an integrated circuit operable in at least a first and second mode, and a dial having a window through which at least one indicator is visible, wherein the electronic device comprises a mode indicator positioned on an actuation mechanism side of the dial, wherein the mode indicator has at least a first indicator and a second indicator each respectively representative of one of the at least two modes within which the electronic device is operable; a gearing assembly comprising one or more wheels, being meshingly coupled to the mode indicator so that the rotation of the one or more wheels causes the rotation of the mode indicator; an actuation mechanism, rotateably coupled to the at least one or more wheels of the gearing assembly, wherein the rotation of the actuation mechanism causes the rotation of the mode indicator; wherein the integrated circuit controls the actuation of the actuation mechanism so as to initiate the rotation of the mode indicator; and actuation means, operatively coupled to the controller, for selecting the mode within which the integrated circuit is operable, wherein the mode within which the integrated circuit is operating is visible through the window in the dial; wherein the mode in which the integrated circuit is operating is indicated by the indicator visible in the window.

10 Claims, 6 Drawing Sheets

MULTIMODE ELECTRONIC DEVICE WITH CALIBRATING/SETTING MECHANISM

RELATED APPLICATIONS

This application claims the benefit of U.S. Provisional Application No. 60/754,851, filed Dec. 29, 2005.

BACKGROUND OF THE INVENTION

The present invention is directed generally to electronic devices operable in a plurality of modes, such as a timepiece and a wristwatch in particular, and in particular, to an improved methodology and construction for setting/calibrating each of the modes within which the device is operable.

Ideas to assist users in setting and/or calibrating an electronic device, such as a wristwatch, are broad and varied. For example, in watches commonly referred to as "digital" watches, actual printed text may be provided along the bezel of the device (or on the display itself) to prompt users through a setting and/or calibration sequence.

In "analog" watches, the idea of printing on the watch bezel is less than desirable, and may even be less than practical since limited information, if any at all, can be provided on the bezel itself while still remaining aesthetically pleasing. Therefore, a perceived deficiency in the prior art is the ability to provide a user with easy to remember steps for setting/calibrating displayable information in an electronic device of the "analog" type.

As such electronic devices become more sophisticated and complicated, designers continue to look for ways to facilitate a user's interaction with the device. One method and construction believed to have advanced the state of the art is disclosed in coowned and copending U.S. application Ser. No. 11/022,435, the subject matter of which is incorporated by reference as if fully set forth herein. The method and construction set forth in the foregoing '435 application is one example of an interface that assists the user through a setting/calibration sequence for a plurality of display hands in an electronic device.

Although the present invention is applicable to a device that utilizes a plurality of hands, it is not so limited thereby. As such, it will be seen that it is desirable to provide an improved interface to guide a user through a calibration/setting sequence or sequences in an electronic device of the type disclosed herein.

It is believed that the foregoing is best achieved by providing a rotating mode indicator with visible indicators representative of the mode in which the device is operating. In this way, the user need not remember complicated sequences or the order in which the modes are settable and/or calibrated since the device itself will in effect prompt (or otherwise alert) the user accordingly.

SUMMARY AND OBJECTIVES OF THE INVENTION

It is thus an objective of the present invention to overcome the perceived deficiencies in the prior art.

Specifically, it is an objective of the present invention to provide an improved user interface for setting and/or calibrating displayable information in one or more modes in an electronic device.

Moreover, it is an object of the present invention to provide an improved user interface that facilitates a user's ability to set and/or calibrate displayable information in one or more modes in an electronic device, such as, but not limited to, a timepiece (e.g. a watch).

Further objects and advantages of this invention will become more apparent from a consideration of the drawings and ensuing description.

The invention accordingly comprises the features of construction, combination of elements, arrangement of parts and sequence of steps which will be exemplified in the construction, illustration and description hereinafter set forth, and the scope of the invention will be indicated in the claims.

To overcome the perceived deficiencies in the prior art and to achieve the objects and advantages set forth above and below, the present invention is, generally speaking, directed to an electronic device comprising a controller having an integrated circuit operable in at least a first and second mode, and a dial having a window through which at least one indicator is visible, wherein the electronic device comprises a mode indicator positioned on an actuation mechanism side of the dial, wherein the mode indicator has at least a first indicator and a second indicator each respectively representative of one of the at least two modes within which the electronic device is operable; a gearing assembly comprising one or more wheels, being meshingly coupled to the mode indicator so that the rotation of the one or more wheels causes the rotation of the mode indicator; an actuation mechanism, rotateably coupled to the at least one or more wheels of the gearing assembly, wherein the rotation of the actuation mechanism causes the rotation of the mode indicator; wherein the integrated circuit controls the actuation of the actuation mechanism so as to initiate the rotation of the mode indicator; and actuation means, operatively coupled to the controller, for selecting the mode within which the integrated circuit is operable, wherein the mode within which the integrated circuit is operating is visible through the window in the dial; wherein the mode in which the integrated circuit is operating is indicated by the indicator visible in the window. In a preferred embodiment, the electronic device is a wristwatch.

BRIEF DESCRIPTION OF THE DRAWINGS

The above set forth and other features of the invention are made more apparent in the ensuing Description of the Preferred Embodiments when read in conjunction with the attached Drawings, wherein.

Identical reference numerals in the figures are intended to indicate like parts, although not every feature in every figure may be called out with a reference numeral.

DETAILED DESCRIPTION OF THE PREFERRED EMBODIMENTS

Figure 1:
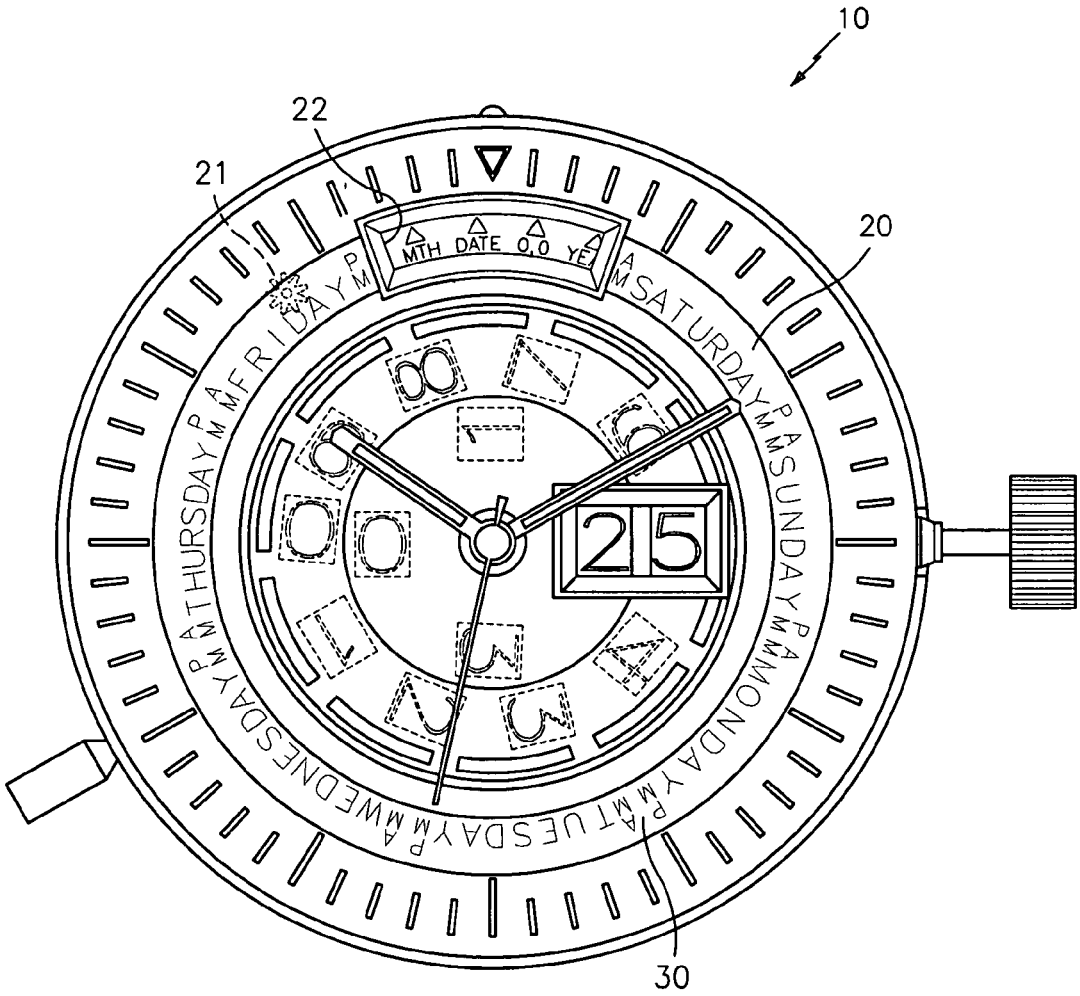
FIG. 1 is a top plan view of a wearable electronic device, with part of the dial being shown transparently so that details of a preferred gearing assembly and mode indicator can be more easily illustrated and disclosed.

The present invention is directed to an electronic device that is operable in a plurality of modes, such as by way of example and not limitation, a plurality of setting modes, such as a month setting mode, a date setting mode, a leap year setting mode, a day setting mode and a year setting mode, just to name a few.

In the preferred embodiment, the electronic device is a wristwatch. However, it should be understood that the present invention need not be a wristwatch, as other devices are very much contemplated hereby, and thus covered by the present claims. Reference should be made to co-owned and co-pending application Ser. No. 10/441,417, the disclosure of which is incorporated by reference as if fully set forth herein, which makes it clear that the device of the present invention can operate in a plurality of modes that, if the electronic device were to be modified accordingly, could be appreciated in connection with the present invention.

To be sure, the present invention is applicable to a wide variety of devices and applications. That is, while the following embodiments will be disclosed in connection with the setting and/or calibrating of a plurality of modes related to the day, date, month and year, the scope of the invention is not so limiting.

Reference is first made generally to FIGS. 1-4, which illustrate an electronic device, generally indicated at 10, constructed in accordance with the present invention and preferably a timepiece (e.g. watch). Many of the details of FIGS. 1-4 will be omitted for purposes of brevity, but the reader is invited to read copending and coowned application Ser. Nos. 11/174,095 and 10/441,417, the disclosures of which are incorporated by reference as if fully set forth herein, as these applications also disclose many other non-essential details related to the present invention.

For example, the present disclosure omits, for purposes of brevity, certain basic and very well known concepts regarding the construction of an analog timepiece. For example, the basic construction and arrangements of gears and/or gear trains to rotate a plurality of "standard" hands all supported on a center stem, such as an hour hand, a minute hand and a "seconds" hand, will be omitted as being well within the purview of one skilled in the art.

Device 10 comprises a module, generally indicated at 15, constructed in accordance with the present invention. In fact, a suitable module for use in the present invention and further details of the construction of such a module can be found in the aforementioned '095 and '417 applications.

In a completed assembly and to carry out normal (e.g. hour/minute timekeeping, day and date) functionality, module 15 is provided with one or more subassemblies, each of which may comprise at least one actuation mechanism and one or more gears rotateably engaged with the actuation mechanism, wherein actuation of the actuation mechanism causes the rotation of the one or more gears. The preferred actuation mechanisms are stepper motors designated generally in the figures as M1, M2, M3 and M4 all of which are disposed in module 15. As would be understood in the art, their specific location is one of design choice and dictated by constraints such as spacing, power and torque requirements.

As positioned in module 15, motor M4 is provided to rotate pinion 17, which itself may be part of an additional gear/wheel, and the rotation of the rotor of motor M4 imparts rotation of pinion 17 via a gear train, generally indicated at 19. The purpose of motors M1, M2 and M3 are not material to the present invention, although details thereof can be found in the aforementioned applications. Also, as will be mentioned again below, a very suitable timepiece construction that can be incorporated into a device of the present invention is disclosed in the aforementioned '435 application, since the present invention is well suited for calibrating/setting a plurality of hands as disclosed in said '435 application.

With the foregoing assemblies being deemed to be incorporated herein, reference can now be made to the particulars of the present invention.

Figure 2:
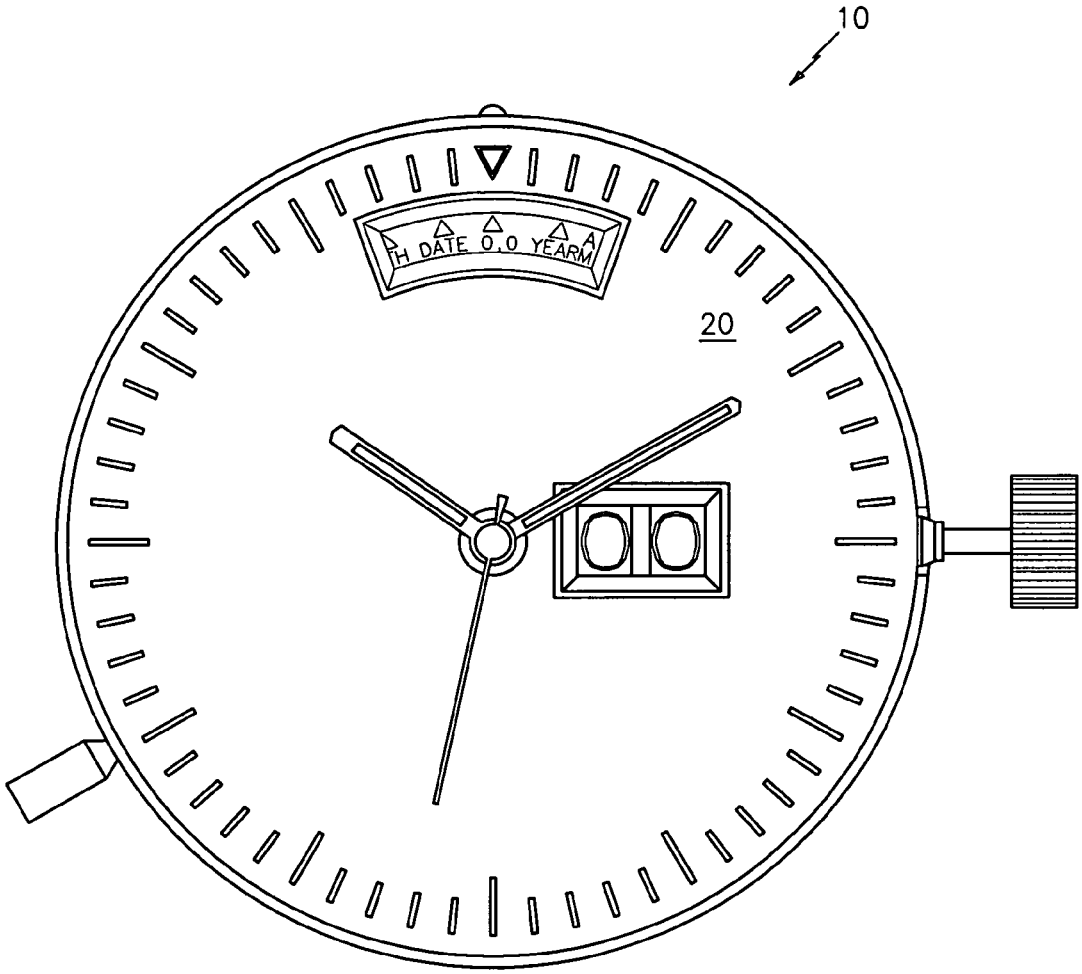
FIG. 2 is a top plan view of the wearable electronic device of FIG. 1 showing a non-transparent dial.
Figure 3:
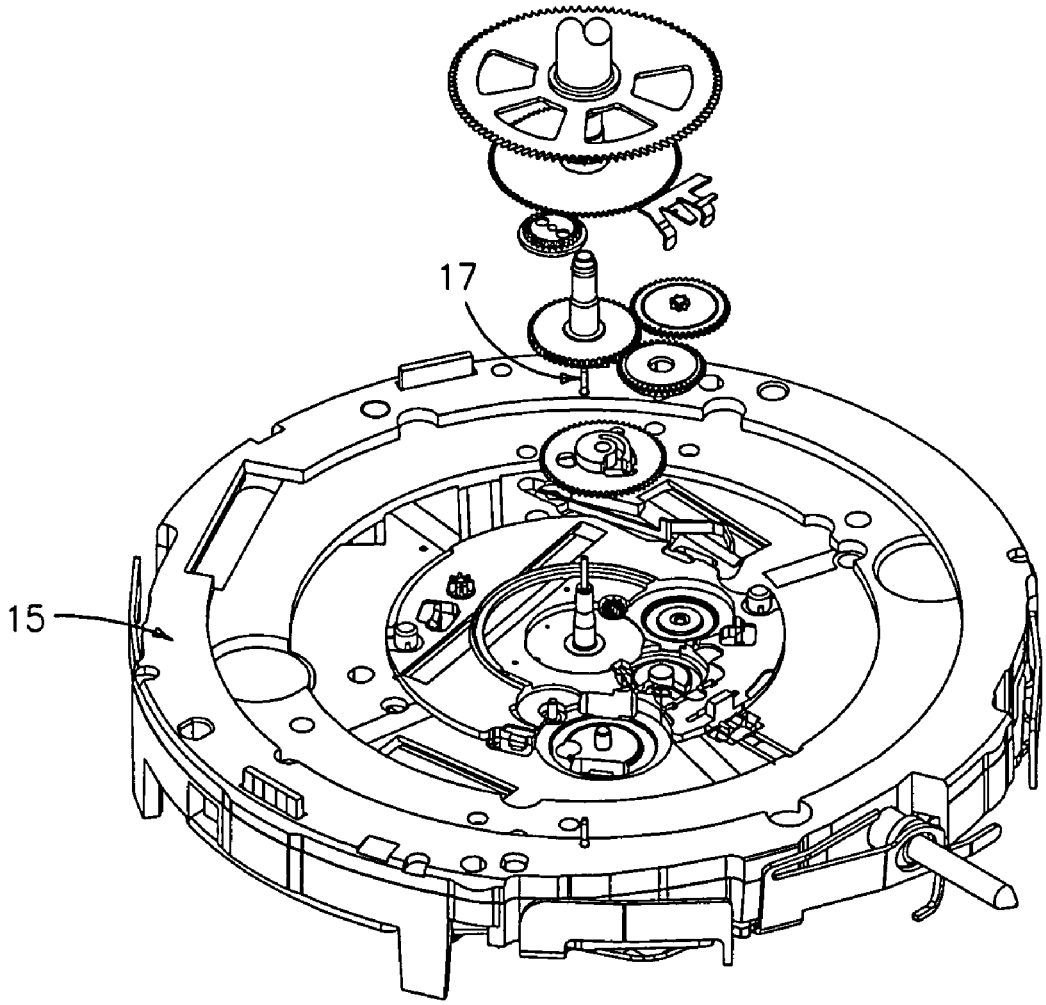
FIG. 3 is a perspective view of a module for use in connection with the present invention.
Figure 4:
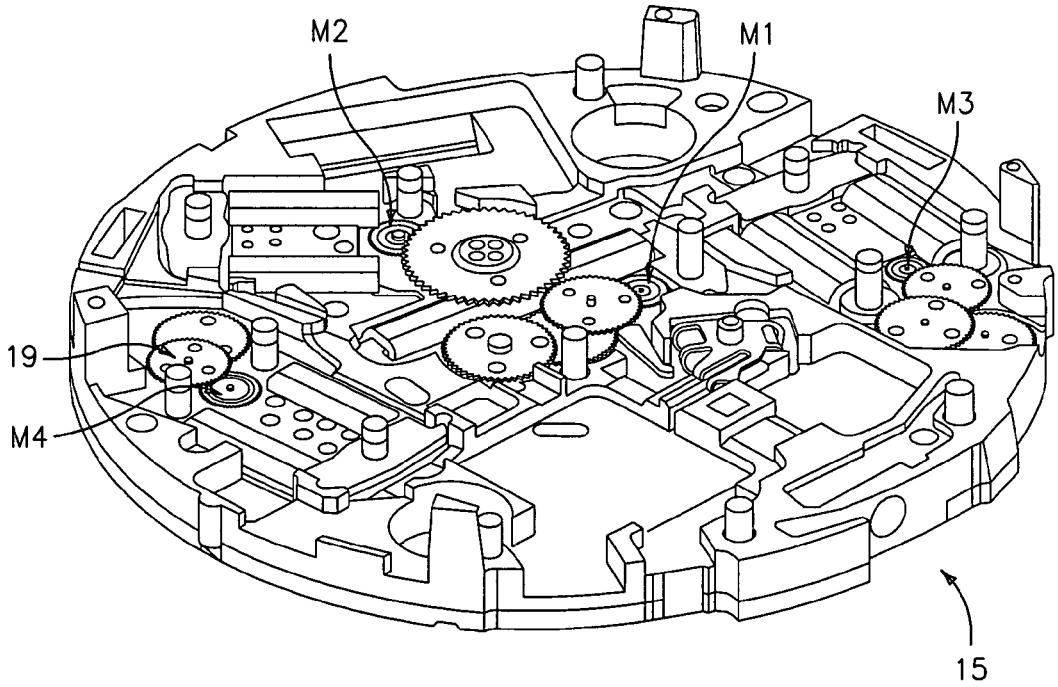
FIG. 4 is a perspective view of a movement assembly in the module of FIG. 3 for a wearable electronic device constructed in accordance with the present invention.

Reference is thus made specifically to FIGS. 1 and 2, wherein device 10 comprises a dial 20 having a window 22, through which at least one indicator is visible. In the embodiment of FIGS. 1 and 2, the visible indicators are "MTH (month)," "DATE," "0.0" and "YEAR." Preferably, all of the indicators are provided on a mode indicator, generally indicated at 30. In the preferred embodiment, mode indicator 30 is a ring positioned underneath (i.e. on the actuation side) of dial 20, although a mere elongated member may also be used. Other indicia may be provided on mode indicator 30, such as the day indicators (e.g. "SUNDAY," "MONDAY," "TUESDAY," . . . "SATURDAY"), details of which are the subject of an invention not material hereto.

To rotate mode indicator 30, gearing assembly 19 comprises one or more wheels that meshingly couple to mode indicator 30 so that the rotation of the one or more wheels causes the rotation of the mode indicator. Specifically, a pinion 17 (FIG. 3) may be included in gearing assembly 19. More specifically, a gear 21 may be provided on pinion 17 and be meshingly coupled to the mode indicator. Specifics of how a stepping motor may be operatively coupled to a gearing assembly and in turn coupled to mode indicator 30 may also be seen in coowned and copending application Ser. No. 11/221,031, the subject matter of which is also incorporated by reference as if fully set forth herein. As such, actuation mechanism M4, rotateably coupled to the at least one or more wheels of gearing assembly 19, provides the rotation of mode indicator 30.

A controller 100, operatively coupled to actuation mechanism M4, is provided for causing the rotation of the mode indicator to rotate in a manner to be hereinafter disclosed. However, prior to disclosing the specific manner of rotation of mode indicator 30, reference is first generally made to FIGS. 5 and 6, which illustrate a controller to provide the proper and accurate controlling, positioning and rotation of mode indicator 30. Details of a generic controller for controlling either of the embodiments of the present invention can be found in the applications incorporated by reference herein. The controller of the present invention preferably comprises all of the functional features described with respect to controller 100 in the aforementioned applications to carry out the objectives and features of the present invention. The functionality particular to the present invention shall now be disclosed.

Figure 5:
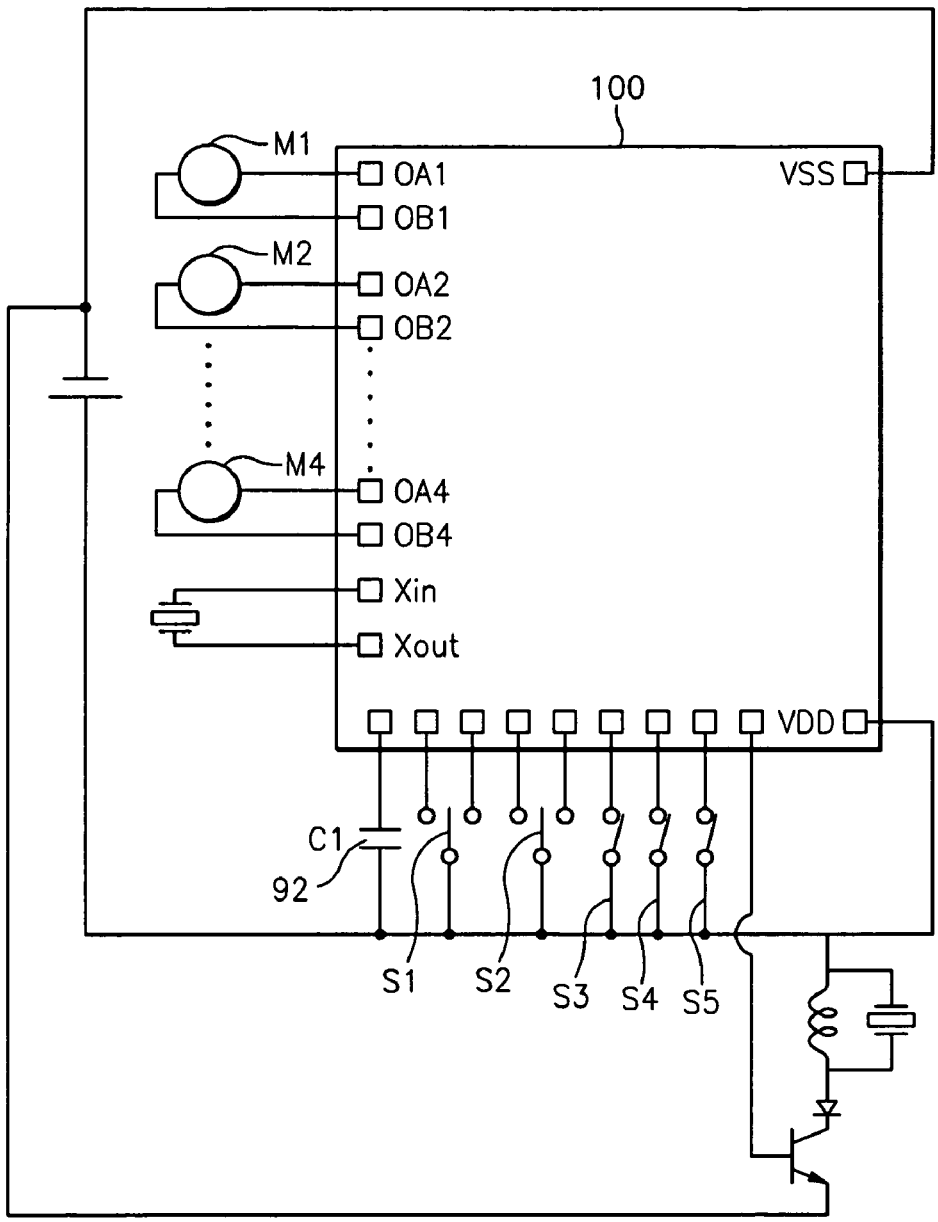
FIG. 5 is a circuit diagram for an electronic device constructed in accordance with the present invention.
Figure 6:
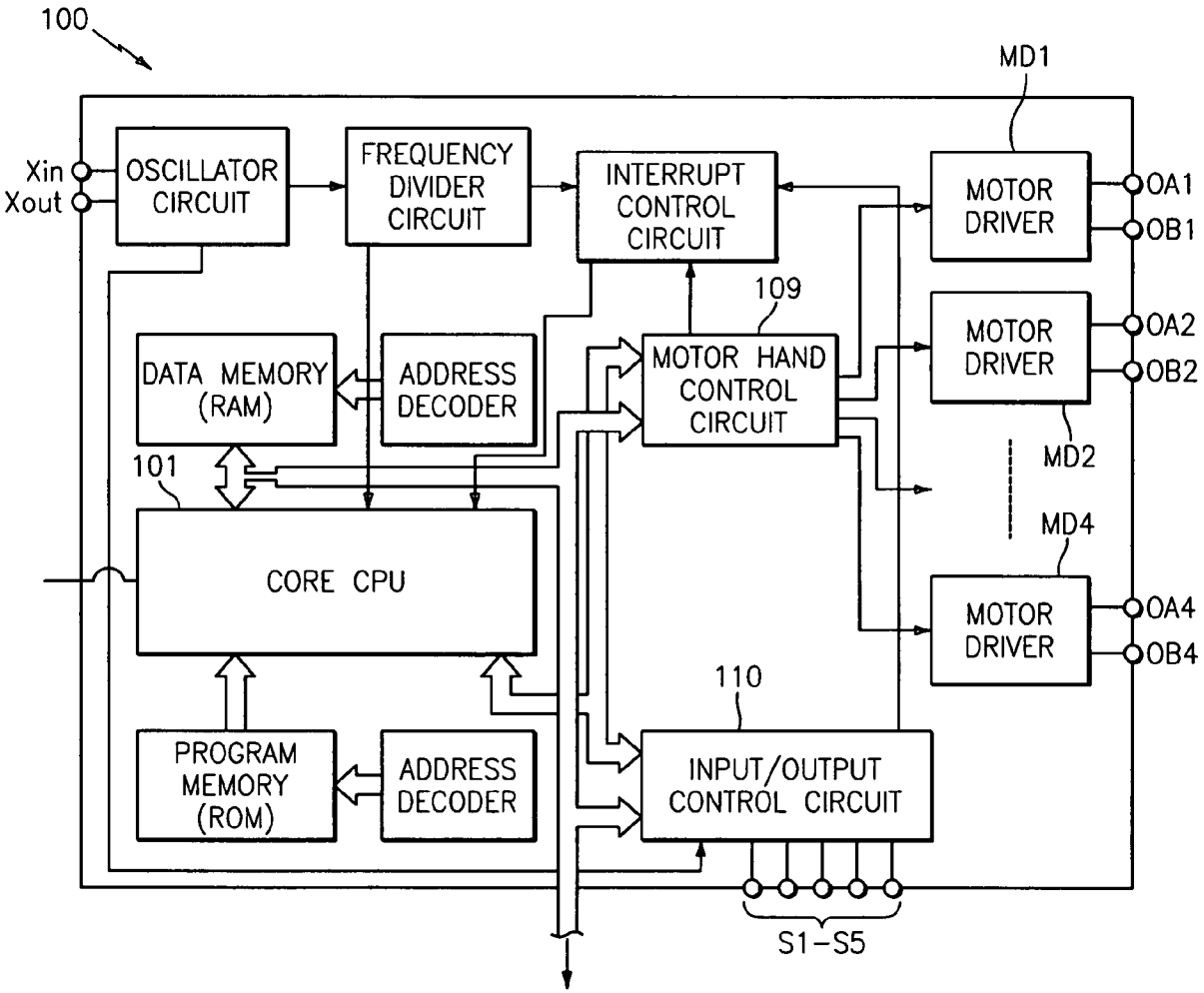
FIG. 6 is a block diagram of a controller for use in an electronic device constructed in accordance with the present invention.

FIGS. 5 and 6 illustrate among other things, interface connections to motors M1, M2, M3 and M4 and switches S1-S5. Switches S1-S5 are intended to generically indicate both side/top mounted pushers, as well as side mounted rotateable crowns, and thus respond to the actuation (i.e. pulling and/or pushing) action thereof. In the case of crowns, the pulling and or pushing actuations may be provided for setting and/or calibrating hands and/or mode indicator 30. Reference to coowned and copending U.S. application Ser. No. 10/737,406, the subject matter of which is incorporated by reference as if fully set forth herein, may be had for a more detailed and applicable disclosure of ring calibration and/or display hand calibration. Calibration, if any, permits controller 100 to "know" the position of mode indicator 30. An input/output control circuit 110 controls the crown actuations and push-button switches and provides such signaling information to CPU 101.

Particular reference is also made to motor control circuit 109, which receives a commanded "next number of pulses" from CPU core 101 and generates the pulsed and phased signals necessary to move a desired motor (e.g. M4) a desired amount and in a desired direction. Pulse outputs of motor control circuit 109 are buffered by motor drivers MD1, MD2, MD3, and MD4 and applied to respective motors M1, M2, M3, M4.

By appropriate configuration and programming of controller 100 it is thus possible to ensure that the functionality, operation and proper stepping (e.g. of stepping motor M4) is achieved. Also, those skilled in the art will know how to program controller 100 so that it may be customized or changed to properly control the particular display indicator (e.g. mode indicator 30).

Although the preferred embodiment provides that controller 100 is highly integrated wherein all timing and display functionality is controlled in controller 100, alternate embodiments could separate the timekeeping functions from other processing functions, as would be understood by one skilled in the art.

Any of the illustrated switches (e.g. switches S1 and S2) are intended to generically indicate both side/top mounted pushers and generically indicates the setting stem/crown. Obviously, any of the switches (e.g. S1 and S2) are intended to be actuated by pushing while setting the stem/crown can be axially displaced and/or rotated in a clockwise and/or counterclockwise direction, as set forth quite advantageously in application Ser. No. 10/331,827, the disclosure of which is also incorporated by reference as if fully set forth herein. Collectively and individually, pushers S1 and S2 and the setting stem/crown shall be deemed the "setting/calibration" mechanism of the present invention. All other features and components, including the aforementioned features will find correspondence in one or more of the above-identified applications.

Turning to the specifics of the present invention, an advantageous feature is the combination of using means (e.g. pushers or the crown) to change operating (e.g. setting and/or calibration) modes of the electronic device and means (e.g. mode indicator 30) to indicate within which mode the device is operating. The first referenced means (e.g. use of the pushers and/or the crown) to change operating modes is well-known in the art, as evidenced by the many patents in this area, for example, U.S. Pat. Nos. 5,742,565; 4,989,188; 4,783,773; 4,780,864; 4,283,784 and 5,555,226, the subject matter of all of which are incorporated by reference as if fully set forth herein.

Now, with the present invention, the user can be prompted or otherwise be made aware of the mode within which the device is operating. In an equally sophisticated embodiment, the user can select the mode within which the user desires to operate by appropriately rotating mode indicator 30 until the desired mode is indicated in the window. Again, reference to those applications identified above provides a detailed disclosure of the actual rotation of mode indicator 30.

Thus the present invention provides the ability for all the displayable information, e.g. day, month, year, leap year and date to be calibrated/set. Again, mode indicator 30 can itself be calibrated by reference to application Ser. No. 10/737,406. Again, this ensures that controller 100 "knows" the position of mode indicator 30. Also, as the present invention contemplates the incorporation of one or more display hands to indicate the month or year, for example, the present disclosure should be deemed to include the functionality and use of the display hands of the aforementioned '435 application.

In this way, with mode indicator 30 in the position of FIG. 2 for example (i.e. with "0.0" being indicated), any and all display hands and other rings can be calibrated to their "zero" or initialized position using the embodiments and methodology as set forth in the aforementioned application Ser. No. 10/737,406. Also, by default it is possible to ensure that the device always fist enters the calibration mode indicated by the "0.0" indicator.

Subsequently, actuation of one or more selected pushers and/or the crown (which can be selected by software programming techniques) will cause the device to selectively enter one or more operating modes of the device. To assist in guiding the user through the calibrating/setting of displayable information, mode indicator 30 will rotate so as to prompt the user through the calibrating/setting operations. For example, mode indicator 30 may next rotate to the "DATE" indicator (e.g. as illustrated in FIG. 1) indicating that the date is the next parameter to calibrate/set. After completing the date calibrating/setting, actuation of a selected actuator (e.g. pusher or crown) will cause the controller to rotate mode indicator 30 so as to display/indicate (e.g.) the "MTH" indicator, now indicating that the accurate month must be set. This sequence can be repeated for any and all information to be set, such as the year (i.e. taking into account leap year information) or the day. Again, this invention nicely complements the invention set forth in the '435 application.

Advantageously, the subject matter of coowned and copending U.S. application Ser. Nos. 10/342,512 and 10/76,011 are incorporated by reference as if fully set forth herein. These two disclosures will assist the user in constructing a suitable date mechanism (i.e. the '512 application) and assurances for accurate day/day maintenance through a perpetual calendar construction/methodology (i.e. the '011 application).

To be sure, the phrase "setting/calibration" (and all forms of the words (e.g. "set/calibrate")) is intended to broadly cover any setting and/or calibrating operation of a particular display hand or ring. For example, in the context of a hand (or ring) displaying days of the week, rotating the hand (or ring) from the "Sunday" position to the "Monday" position would be deemed to be "setting/calibrating" the hand (or ring). Similarly, resetting of a hand (or ring(s)) to a one ("01") position would also be "setting/calibrating" the hand (or ring, as the case may be). Therefore, and generally speaking, the intentional movement of the hand or ring by a user interfacing with the device (as opposed to the natural internal progression of the hands) should be deemed to be "setting/calibrating" thereof.

The preferred methodology may begin with the initiation of an actuation sequence, which in the preferred embodiment, is achieved by the actuation of the setting/calibration mechanism, which can be achieved by a particular button push (or sequence of several button pushes) or crown rotation, or preferably with a pull of the crown into a second of at least two axial positions.

The present invention also provides for the option should no setting/calibration be needed/desired. In such a situation, mere inaction on the part of the user for a predetermined period of time (or subsequent selected actuation of the actuation mechanism) could be sufficient to avoid a particular calibration/setting of a mode.

The foregoing sequence can be expanded to any number of display hands or rings, and the embodiments in those applications incorporated by reference herein show the wide ranging applicability of the present invention. Particular to the present invention, all that would have to be modified would be the indicators on mode indicator 30 and the controller would have to be modified accordingly. Thus, the present invention provides an alternative method and construction for simply, intuitively and more easily setting/calibrating a plurality of parameters (e.g. date, day, year, month) in an electronic device that is of the "analog" type (i.e. uses rings and/or hands to display information).

Exiting of the setting/calibration mode is likewise facilitated by actuation of a pusher or selected axial displacement of the setting stem back to the "normal" or run position, examples of which can be found in the applications incorporated by reference herein.

Again, it should be clear that while the present invention is illustrated with respect to a display illustrating differing date information, this is by way of example and not limitation as the present invention is applicable to a wide variety of applications.

As indicated above, the present disclosure has omitted for purposes of brevity certain basic and very well known concepts regarding such electronic devices, although among the disclosures set forth above, greater detail can be easily found in the aforementioned '417 and '435 applications. Again, the construction of these respective gear trains are also well within the purview of one ordinarily skilled in the art.

In the preferred embodiment, at least motor M4 is a bidirectional stepper motor thus being able to rotate in either direction, and the construction of acceptable stepper motors to functionally operate in this manner are widely available and well within the understanding of those skilled in the art. Suitable dials are also well within the purview of the skilled artisan. One skilled in the art would recognize that varying the number of display hands can vary the number of needed stepper motors, all of which is within the scope of the present invention and disclosure and disclosed in those applications incorporated by reference herein.

As should also be appreciated by one skilled in the art, the location, position and/or size of the mode indicator and/or display hands are merely dictated, for example, by the position of pinion 17 and the position of the respective subassemblies and thus the illustrations herein are shown by example and not limitation.

The gearing ratio to provide for the desirable display rotation or movement of the display hands or rings would be one of design choice depending on the desired or required incremental rotation of the display indicator. Thus the number of wheels in any particular gearing assembly may be more or less than that disclosed herein, and are really one of design choice for the intended function and based upon a number of criterions known to the ordinary designer. Also, the functionality of the controller can be modified to accommodate the varying embodiments disclosed herein by software-programming techniques or differing controllers, both of which is well within the purview of the skilled artisan.

It can thus be seen that the present invention provides for an improved method and construction for setting and/or calibration rings, elongated members and/or display hands. Specifically, the present invention provides an improved user interface for setting and/or calibrating displayable information in one or more modes in an electronic device, that is easy to use and which should be welcome to the user over those arrangements in the prior art.

It will thus be seen that the objects set forth above, among those made apparent from the preceding description, are efficiently attained and, since certain changes may be made in the above constructions without departing from the spirit and scope of the invention, it is intended that all matter contained in the above description or shown in the accompanying drawings shall be interpreted as illustrative and not in a limiting sense.

It should also be understood that the following claims are intended to cover all of the generic and specific features of the invention described herein and all statements of the scope of the invention that as a matter of language might fall therebetween.

What is claimed is:

1. An electronic device comprising a controller having an integrated circuit operable in at least a first and second mode, and a dial having a window through which at least a first indicator and a second indicator are viewable, wherein the electronic device comprises:

a mode indicator positioned on an actuation mechanism side of the dial, wherein the mode indicator has thereon indicia related to at least the first indicator and the second indicator each respectively representative of one of the at least two modes within which the electronic device is operable;

a gearing assembly comprising one or more wheels, being meshingly coupled to the mode indicator so that the rotation of the one or more wheels causes the rotation of the mode indicator;

an actuation mechanism, rotateably coupled to the at least one or more wheels of the gearing assembly, wherein the rotation of the actuation mechanism causes the rotation of the mode indicator;

wherein the integrated circuit controls the actuation of the actuation mechanism so as to initiate the rotation of the mode indicator; and actuation means, operatively coupled to the controller, for selecting the mode within which the integrated circuit is operable, wherein the controller then causes the integrated circuit to selectively enter a mode selected from the first mode and the second mode, wherein indicia related to the mode within which the integrated circuit is selected to operate is visible through the window in the dial;

wherein the mode in which the integrated circuit is selected to operate is indicated by the indicator visible in the window.

2. The electronic device as claimed in claim 1, wherein one of the modes is a month setting mode.

3. The electronic device as claimed in claim 1, wherein one of the modes is a date setting mode.

4. The electronic device as claimed in claim 1, wherein one of the modes is a leap year setting mode.

5. The electronic device as claimed in claim 1, wherein one of the modes is a day selling mode.

6. The electronic device as claimed in claim 1, wherein one of the modes is a year setting mode.

7. The electronic device as claimed in claim 1, wherein the mode indicator is a ring.

8. The electronic device as claimed in claim 1, wherein at least the first and second indicators are simultaneously visible in the window and including means for particularly indicating one of the first or second indicators.

9. The electronic device as claimed in claim 8, wherein the means for particularly indicating one of the first or second indicators is a pointer.

10. The electronic device as claimed in claim 1, wherein the device is a wristwatch.

* * * * *

UNITED STATES PATENT AND TRADEMARK OFFICE

CERTIFICATE OF CORRECTION

PATENT NO. : 7,420,880 B2
APPLICATION NO. : 11/473716
DATED : September 2, 2008
INVENTOR(S) : Wolfgang Burkhardt et al.

It is certified that error appears in the above-identified patent and that said Letters Patent is hereby corrected as shown below:

Column 8

Line 51, delete “selling” and replace it with --setting--

Signed and Sealed this

Fourth Day of November, 2008

JON W. DUDAS
*Director of the United States Patent and Trademark Office*